United States Patent [19]

McIntyre et al.

[11] 4,312,723

[45] Jan. 26, 1982

[54] CORROSION RESISTANT ELECTROLYTIC CELL

[75] Inventors: John M. McIntyre; Donald L. Caldwell, both of Lake Jackson, Tex.

[73] Assignee: The Dow Chemical Company, Midland, Mich.

[21] Appl. No.: 157,621

[22] Filed: Jun. 9, 1980

[51] Int. Cl.[3] ..... C25B 1/34; C23F 13/00

[52] U.S. Cl. ..... 204/98; 204/128; 204/147

[58] Field of Search ..... 204/147, 98, 128, 296

[56] References Cited

U.S. PATENT DOCUMENTS 3,868,313 2/1975 Gay ..... 204/147

4,057,473 11/1977 Cunningham et al. ..... 204/98

4,213,833 7/1980 Lefevre ..... 204/98

OTHER PUBLICATIONS

Electroplating & Engineering Handbook by A. K. Graham, 1955, p. 410.

*Primary Examiner*—R. L. Andrews

*Attorney, Agent, or Firm*—James H. Dickerson, Jr.

[57] ABSTRACT

An electrolytic cell and its method of operation is described. The cell comprises an anode, a cathode and iron-containing metals exposed to the interior portions of the cell which are maintained at about the same electrical potential as the cathode. These materials are covered with a protective coating to minimize corrosion during operation of the cell.

10 Claims, 1 Drawing Figure

Potential-pH equilibrium diagram for the system iron-water, at 25°C (considering as solid substances only Fe, $Fe_3O_4$ and $Fe_2O_3$)

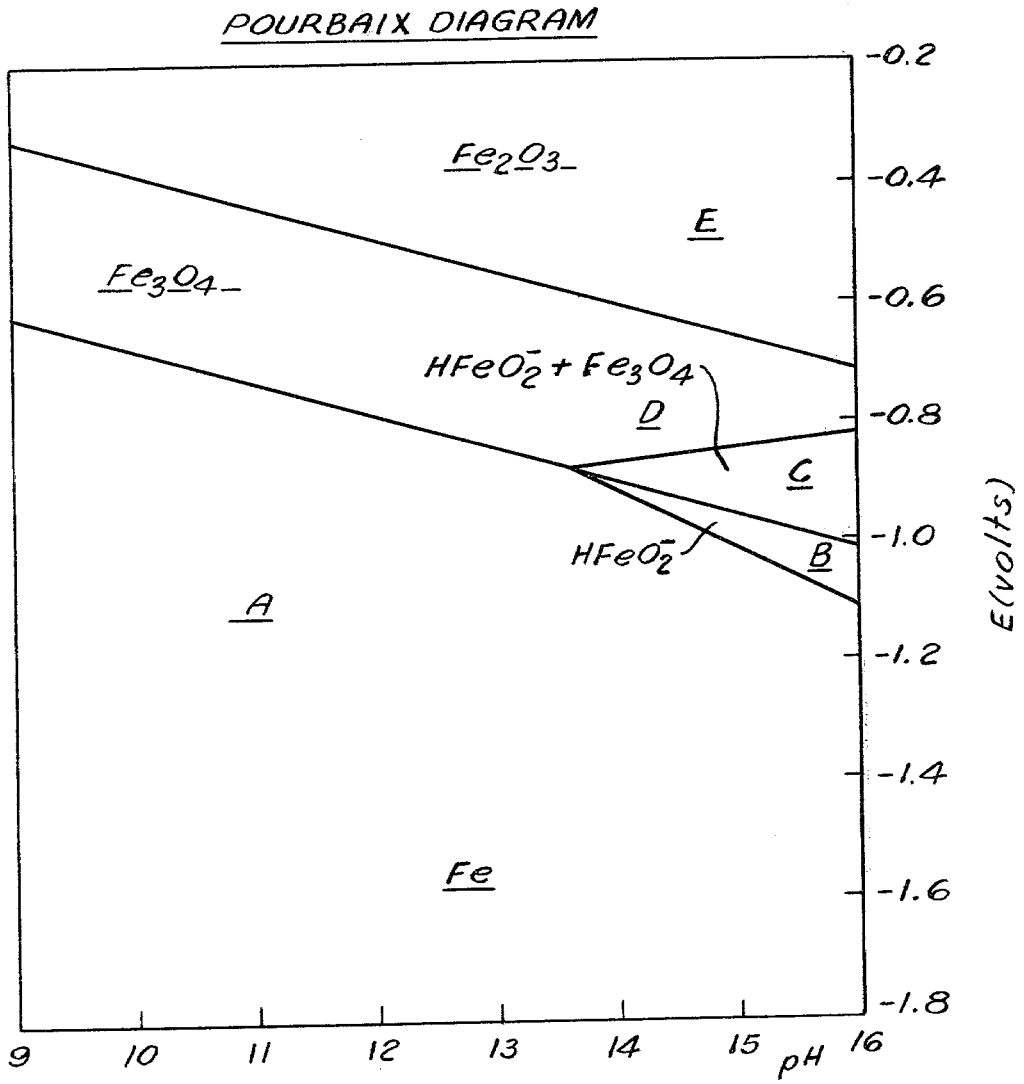
Potential-pH equilibrium diagram for the system iron-water, at 25°C (considering as solid substances only Fe, $Fe_3O_4$ and $Fe_2O_3$)

CORROSION RESISTANT ELECTROLYTIC CELL

This invention deals with electrolytic cells having iron-containing materials exposed to the interior portions of the cell which are maintained at about the same voltage as that of the cathode.

BACKGROUND OF THE INVENTION

Electrolytic cells have found wide uses in modern industrial practice. However, with energy costs increasing, researchers in recent years have investigated means to reduce the energy consumed by electrolytic cells, following numerous approaches. Among the more common techniques used are the modification of the electrodes. For example, low overvoltage cathodes have been used; such cathodes have been described in numerous patents; among those are U.S. Pat. Nos. 2,419,231; 3,272,728; 4,104,133; 4,170,536; 4,162,204; 4,024,044; 3,945,907 and 3,974,058.

Japanese Patent No. 31-6611, published Aug. 7, 1956, shows a nickel/zinc alloy being electroplated onto a nickel-coated, iron substrate, wherein the zinc is subsequently leached from the Ni/Zn alloy by an alkaline solution. A similar process is shown in Netherlands Patent No. 75-07550, laid open to inspection Jan. 20, 1976.

SUMMARY OF THE INVENTION

An electrolytic cell and its method of operation are described. The cell comprises an anode, a cathode, and iron-containing metals exposed to the interior portions of the cell which are maintained at about the same electrical potential as the cathode. These materials are covered with a protective coating to minimize corrosion during operation of the cell.

BRIEF DESCRIPTION OF THE DRAWING

The FIGURE is a Pourbaix diagram showing the potential vs pH for an iron-water system at 25° C.

DETAILED DESCRIPTION OF THE DRAWING

The FIGURE shows the oxidation state of iron as a function of pH and voltage at 25° C. in an iron-water system. If the iron-containing parts of the cell are exposed to pH and voltage conditions which put them into area A of the Pourbaix diagrahm, iron will exist as Fe. Conditions corresponding to area B, will cause iron to exist as $HFeO_2^-$. In area C, iron will exist as a mixture of $Fe_3O_4$ and $HFeO_2^-$. In area D, iron will exist as $Fe_3O_4$ while in area E, iron will exist as $Fe_2O_3$. pH and voltage conditions corresponding to areas A, D and E will cause iron to exist in a solid state. However, if iron-containing parts are subjected to pH and voltage conditions corresponding to areas B or C iron will ionize and cause iron impurities in the electrolytic products.

DETAILED DESCRIPTION OF THE INVENTION

Although voltage reduction techniques are economical, in that they save energy, it has been discovered that there are problems associated with such techniques. One of the more serious problems is the fact that frequently the electrolytic products contain a greater amount of impurities than do products produced from conventional cells. For example, when low overvoltage cathodes are used in a chlor-alkali electrolytic process, it has been found that the caustic produced frequently contains a greater concentration of iron than caustic produced from cells using conventional cathodes. Since low overvoltage cathodes are typically coated with nickel or some other corrosion-resistant metal coating, it is surprising that the iron contamination in such a cell is greater than when conventional, iron or steel cathodes are used.

It has been found that the iron contamination present in the products produced by electrolysis when a low cathode voltage is used, comes from iron-containing cell parts which are exposed to the interior portions of the cell and are maintained at about the same voltage as the cathode. An example of a source of iron contamination is a backscreen or some other type of cathode support that is frequently used in electrolytic cells. It has been found that if at least a portion of the iron-containing metallic parts of an electrolytic cell which are exposed to the interior portions of the cell are at least partially covered with a protective coating, iron contamination in the electrolytic products is minimized.

The protective coating used to coat the iron-containing parts of the cell should be stable at the applied electrical voltage, substantially stable at the temperature of the cell, substantially unreactive with the catholyte, and substantially stable at the pH. Examples of some coatings which may be used are nickel, titanium, vinyl ester resins, epoxy and various other plastics. Nickel, however, is the preferred coating since it conforms nicely to the physical and chemical requirements of the coating.

Optionally, the backscreen or other iron-containing parts of the cell may be constructed from the materials which have been listed as being good protective coatings. For example, the backscreen may be a nickel screen, rather than a nickel-coated iron screen.

When conventional iron or steel cathodes are used in an electrolytic cell for the electrolysis of water or a brine solution, the cathode is normally maintained at a voltage of approximately −1.1 to −1.2 volts vs. Normal Hydrogen Electrode (N.H.E.). The pH range is normally above approximately 13. These conditions would place iron-containing parts of the cell into area A of the FIGURE. Any iron present on the cathode or any other iron in the cell which is maintained at a similar voltage will not ionize but will exist as Fe. However, if the voltage is reduced so that the cathode operates at approximately −0.8 volt to approximately −1.1 volts vs. N.H.E., the cell conditions enter areas B and/or C of the FIGURE where $HFeO_2^-$ will form and iron will ionize. Ionization of the iron-containing parts will cause iron contamination of the products of the cell.

The invention may be used in any electrolytic cell wherein the voltage and pH conditions place iron-containing parts of the cell under conditions where iron will ionize. In such a system, any iron-containing parts which are electrically connected with the cathode, or maintained at a voltage about the same as the cathode, will cause iron to ionize and will contaminate the products of the electrolysis. The invention may be used to minimize iron contamination of the products.

It should be understood that the Pourbaix diagram which was selected for illustration of the invention is for 25° C. in an aqueous system which is chloride free. However, most electrolytic cells operate at elevated temperatures. For example, chlor-alkali cells normally operate at 50°-100° C. The voltage required to ionize iron under given pH ranges will vary with temperature, thus, while iron will ionize at voltages of about −0.8 to −1.1 volts vs. N.H.E. at 25° C., the voltage to cause ionization at 100° C. in chloride-containing systems will be slightly different.

The following examples illustrate the invention in a chlor-alkali electrolytic cell. However, it should be well understood that the invention may be used in any electrolytic cell wherein an aqueous solution is electrolyzed and wherein there are iron-containing parts electrically connected with the cathode or parts which are maintained at a voltage about the same as that of the cathode.

EXAMPLE

Four 11 square foot cathodes were tested in diaphragm chlor-alkali cells: One conventional low-carbon steel cathode having an uncoated backscreen; one low overvoltage cathode having an uncoated backscreen; and two low overvoltage cathodes, each having a backscreen coated with a protective nickel coating. The protective coating was applied by electroplating a steel cathode with a nickel-zinc alloy, then removing the zinc by soaking in an alkaline solution, leaving a high-surface area nickel coating.

Each of the cells was fed a saturated NaCl brine solution and was maintained at a temperature of about 70° C. The same brine source fed all cells, thus the brine for each cell had the same iron content. Upon start-up, each of the cells was operated at approximately 800 amps and produced an approximately 10 weight percent NaOH catholyte solution. The conventional steel cathode cell produced a catholyte having 1.7 ppm Fe. The low overvoltage cathode having an uncoated backscreen produced a catholyte having 1.6 ppm Fe. However, the two low overvoltage cathodes having a nickel coated backscreen produced catholytes having 0.7 and 0.5 ppm Fe, respectively.

After operating several weeks at 800 amps, the current on each cell was lowered to 150 amps, thus reducing the cathode overvoltage. At 150 amps, the standard steel cathode cell produced a catholyte having 0.2 ppm Fe; the low overvoltage cathode having an uncoated backscreen produced a catholyte having 0.4 ppm Fe; and the two low overvoltage cathodes having nickel coated backscreens each produced catholytes having 0.06 ppm Fe.

The four cells were then shut down for a few days and restarted. Upon start-up, the standard steel cathode cell produced a catholyte having 1.7 ppm Fe; the low overvoltage cathode cell having an uncoated backscreen produced a catholyte having 2.4 ppm Fe; and each of the two low overvoltage cathode cells having a coated backscreen produced catholytes having 0.5 ppm Fe.

What is claimed is:

1. An electrolytic cell comprising an anode in an anode chamber; a low-overvoltage cathode in a cathode chamber; iron-containing materials exposed to the interior portion of the cathode chamber and electrically connected to the cathode; wherein at least a portion of the iron-containing material is coated with a protective coating at a level sufficient to minimize ionization of iron.

2. The cell of claim 1 wherein the protective coating is a metal or a metal alloy.

3. The cell of claim 2 wherein the protective coating is nickel or an alloy thereof.

4. The cell of claim 2 wherein the protective coating is titanium or an alloy thereof.

5. A method of operating an electrolytic cell which has an anode in an anode chamber; a low overvoltage cathode in a cathode chamber; iron-containing materials exposed to the cathode chamber and coated with a protective coating at a level sufficient to minimize the ionization of iron wherein the iron-containing materials are electrically connected with the cathode; and means for impressing a voltage on the anode and on the cathode said method comprising:

feeding an aqueous electrolyte solution to the anode chamber;

impressing a sufficient voltage to the anode and the cathode to cause electrolytic reactions to occur; wherein said voltage maintains the iron containing materials at a voltage level about the same as the voltage of the cathode; and removing the products of electrolysis.

6. The method of claim 5 wherein the electrolyte is an NaCl solution.

7. The method of claim 5 wherein the products of electrolysis comprise chlorine and NaOH.

8. The method of claim 5 wherein the protective coating is nickel or an alloy thereof.

9. The method of claim 5 wherein the cathode is maintained at a voltage of from about −0.8 to about −1.1 volts, vs. Normal Hydrogen Electrode.

10. The method of claim 5 wherein the cathode voltage and the pH of the products of electrolysis put the cell under conditions which would cause the iron in the iron-containing parts of the cell to ionize were it not for the protective coating.

* * * * *